US008552323B2

(12) United States Patent
Yasunaga et al.

(10) Patent No.: US 8,552,323 B2
(45) Date of Patent: Oct. 8, 2013

(54) PUSH SWITCH

(75) Inventors: Seiji Yasunaga, Okayama (JP); Masatsugu Takeuchi, Okayama (JP)

(73) Assignee: Panasonic Corporation, Osaka (JP)

( * ) Notice: Subject to any disclaimer, the term of this patent is extended or adjusted under 35 U.S.C. 154(b) by 182 days.

(21) Appl. No.: 13/100,547

(22) Filed: May 4, 2011

(65) Prior Publication Data

US 2011/0284357 A1 Nov. 24, 2011

(30) Foreign Application Priority Data

May 20, 2010 (JP) ..... 2010-115995

(51) Int. Cl.
*H01H 13/14* (2006.01)

(52) U.S. Cl.
USPC ..... 200/530

(58) Field of Classification Search
USPC ..... 200/310, 5 A, 5 R, 511–513, 520, 521, 200/308, 311, 313, 314, 317, 337, 341, 343, 200/345, 292, 329, 406
See application file for complete search history.

(56) References Cited

U.S. PATENT DOCUMENTS

| | | | | |
|---|---|---|---|---|
| 6,373,008 | B1 * | 4/2002 | Saito et al. | 200/310 |
| 6,820,494 | B2 * | 11/2004 | Morimoto | 73/780 |
| 7,312,790 | B2 * | 12/2007 | Sato et al. | 345/173 |
| 2004/0104727 | A1 | 6/2004 | Morimoto | |
| 2008/0029376 | A1 * | 2/2008 | Ngoagouni | 200/345 |
| 2008/0142350 | A1 | 6/2008 | Karaki et al. | |

FOREIGN PATENT DOCUMENTS

| | | | |
|---|---|---|---|
| CN | 101206964 | A | 6/2008 |
| CN | 101364493 | A | 2/2009 |
| JP | 2000-294079 | A | 10/2000 |
| JP | 2009-043653 | A | 2/2009 |
| JP | 2009043653 | A * | 2/2009 |

* cited by examiner

*Primary Examiner* — Edwin A. Leon
*Assistant Examiner* — Anthony R. Jimenez
(74) *Attorney, Agent, or Firm* — RatnerPrestia

(57) ABSTRACT

A push switch includes a first fixed contact and a second fixed contact disposed apart from the first fixed contact. Furthermore, the push switch includes a dome-shaped metallic movable contact facing the first fixed contact with a space therebetween, and a protrusion disposed above a center of the movable contact. When the protrusion is pressed, the movable contact is elastically reversed, and the first fixed contact and the second fixed contact become electrically conductive with each other via the movable contact.

6 Claims, 7 Drawing Sheets

PUSH SWITCH

BACKGROUND OF THE INVENTION

1. Field of the Invention

The present invention relates to a push switch used in input operation sections of various electronic apparatuses.

2. Background Art

Recently, electronic apparatuses have been reduced in size and thickness. Accordingly, push switches mounted on electronic apparatuses have been also reduced in size and thickness. Furthermore, push switches capable of providing an excellent click feeling at the time of operation have been demanded.

A conventional push switch is described with reference to FIGS. 8 to 12. FIG. 8 is a sectional view of a conventional push switch. FIG. 9 is an exploded perspective view of the conventional push switch. Case 1 has an opening on its upper part and is formed of an insulating resin. Center contact 2 is installed in the center of the inner bottom surface of the opening. Outer contacts 3 are installed in two places apart from center contact 2 with a predetermined distance. Terminal 2A is connected to center contact 2, and terminal 3A is connected to outer contact 3. Terminals 2A and 3A are integrated with case 1 formed of an insulating resin by insert molding. Terminals 2A and 3A are led out to the outside from the right and left side surfaces of case 1.

Movable contact 4 is formed of an elastic metal thin plate having an upward convex dome shape. The lower end of the outer periphery of movable contact 4 is placed on outer contact 3, and the lower surface of the center of movable contact 4 faces center contact 2 with a space therebetween. Movable contact 4 is accommodated in the opening of case 1.

Sheet 5 is an insulating film having flexibility. On the lower surface of sheet 5, an adhesive (not shown) is applied. Sheet 5 is fixed to the upper surface of case 1 with the adhesive, and covers the opening so as to protect center contact 2, outer contacts 3 and movable contact 4 from dust or the like.

Next, an operation of the conventional push switch is described. FIG. 10 is a sectional view of the conventional push switch mounted on an electronic apparatus. Terminals 2A and 3A of the push switch are packaged on the upper surface of wiring board 41 by soldering.

Operation button 42 includes pressing part 42A protruding downward and having a circular bottom surface, and operation part 42B protruding upward. Operation button 42 is formed of an insulating resin. Pressing part 42A is brought into contact with an upper surface of sheet 5. Operation part 42B protrudes upward from a hole provided at operation panel 43 of the electronic apparatus.

FIG. 11 is a sectional view showing a state in which movable contact 4 and center contact 2 comes into contact with each other in the conventional push switch. When a pressing force is applied to operation part 42B, the pressing force is applied to the center of movable contact 4 via sheet 5 that is brought into contact with pressing part 42A. When the pressing force is beyond a predetermined force, the center of the dome shape of movable contact 4 is elastically reversed in a downward-convex form with a click feeling and comes into contact with center contact 2. As a result, outer contacts 3 and center contact 2 become electrically conductive with each other via movable contact 4, and the switch is turned on.

Next, when the pressing force from the upper part is removed, the center of the dome shape of movable contact 4 elastically returns to its original upward-convex shape with a click feeling by elasticity of movable contact 4 itself. Accordingly, the center of movable contact 4 is separated from center contact 2, outer contact 3 and center contact 2 are insulated from each other, and the switch is turned off. A returning force of movable contact 4 allows operation button 42 to move upward via sheet 5, and the push switch returns to its original shape shown in FIG. 9.

FIG. 12 is a graph showing a relation between an operation distance and a pressing force in the conventional push switch. The axis of abscissas shows the operation distance and the axis of ordinates shows the pressing force. When a peak pressing force immediately before movable contact 4 is elastically reversed is denoted by P1 and a bottom pressing force immediately after movable contact 4 is elastically reversed is denoted by P2, the ratio of P1 to the difference between P1 and P2 is defined as a click rate. The click rate is represented by $(P1-P2)\times 100/P1$. When the click rate is 30% or more, a light click feeling is obtained. It is further preferable that the click rate is 40% or more and 60% or less.

When a conventional push switch is mounted on an electronic apparatus, a position of the push switch and a position of the electronic apparatus may be displaced from each other. When the center of pressing part 42A is displaced from the center of movable contact 4, the position that is displaced from the center of movable contact 4 is pressed, and thus the click feeling may be dull.

Furthermore, due to variation of the position displacement when the switch is mounted on the electronic apparatus, variation of switch feeling for each electronic apparatus may be increased.

Furthermore, it is demanded to increase an operation distance until the movable contact is elastically reversed so as to obtain a moderate stroke feeling as a feeling transmitted to the finger at the time of pressing.

SUMMARY OF THE INVENTION

A push switch of the present invention includes a first fixed contact and a second fixed contact disposed apart from the first fixed contact. Furthermore, the push switch includes a dome-shaped metallic movable contact facing the first fixed contact with a space therebetween, and a protrusion disposed above the center of the movable contact. When the protrusion is pressed, the movable contact is elastically reversed, so that the first fixed contact and the second fixed contact become electrically conductive with each other via the movable contact.

According to the present invention, even if displacement occurs when a push switch is mounted on an electronic apparatus, the center of a movable contact is pressed. Therefore, a small and thin push switch capable of giving a light and stable click feeling can be achieved.

DETAILED DESCRIPTION OF THE INVENTION

Figure 1:
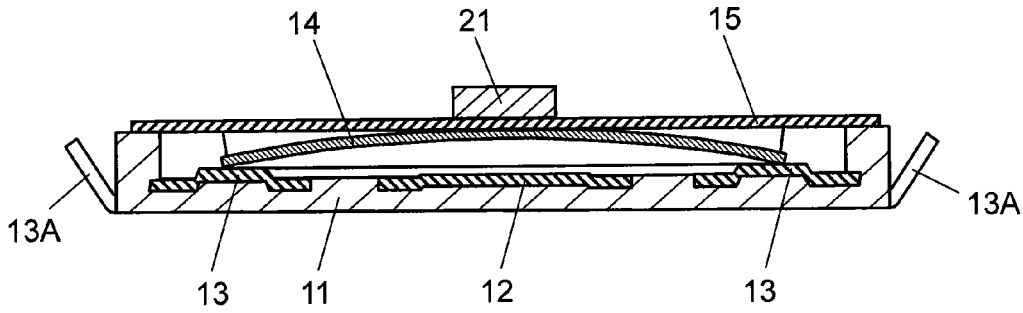
FIG. 1 is a sectional view of a push switch in accordance with an embodiment of the present invention.
Figure 2:
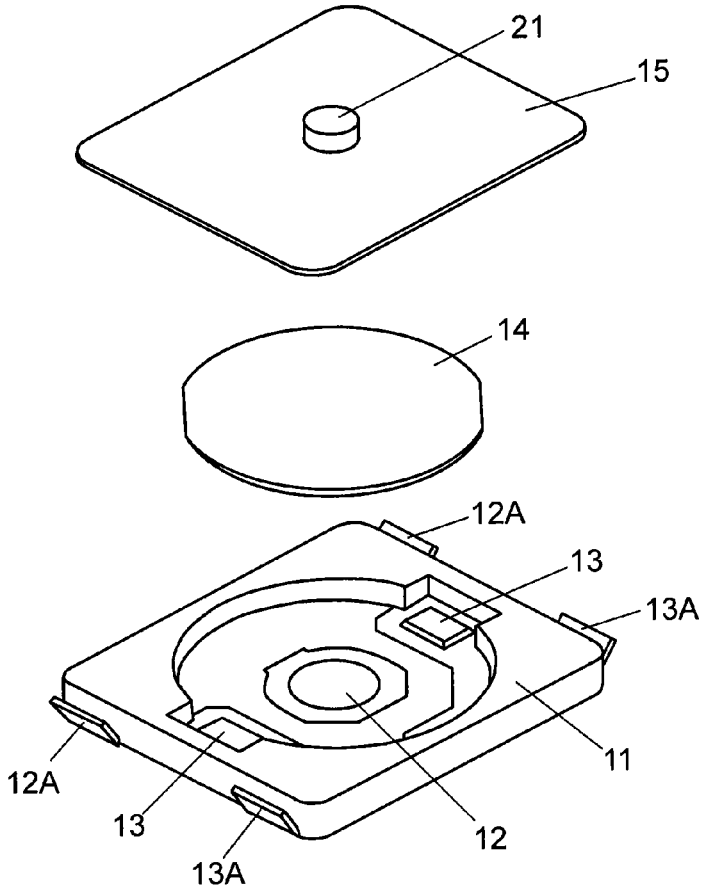
FIG. 2 is an exploded perspective view of the push switch in accordance with the embodiment of the present invention.

FIG. 1 is a sectional view of a push switch in accordance with an embodiment of the present invention. FIG. 2 is an exploded perspective view of the push switch in accordance with the embodiment of the present invention.

The push switch includes center contact 12 (first fixed contact) and outer contacts 13 (second fixed contact) disposed apart from center contact 12. The push switch further includes dome-shaped metallic movable contact 14 facing center contact 12 with a space therebetween, and protrusion 21 disposed above the center of movable contact 14 via sheet 15.

Case 11 is opened upward and is formed of an insulating resin. Center contact 12 is installed in the center of the inner bottom surface of the opening. Outer contacts 13 are installed in two places at a predetermined distance from center contact 12. Terminal 12A is connected to center contact 12, and terminal 13A is connected to outer contact 13. Terminals 12A and 13A are integrated with case 11 formed of an insulating resin by insert molding. Terminals 12A and 13A are led out from the right and left side surfaces of case 11.

Movable contact 14 is formed of an elastic metal thin plate having an upward-convex dome shape. The lower end of the outer periphery of movable contact 14 is placed on outer contacts 13, and the lower surface of the center of movable contact 14 faces center contact 12 with a space therebetween. Movable contact 14 is accommodated in the opening of case 11.

Sheet 15 is an insulating film having flexibility. On the lower surface of sheet 15, an adhesive (not shown) is applied. Sheet 15 is fixed to the upper surface of case 11 with the adhesive, and covers the opening so as to protect center contact 12, outer contacts 13 and movable contact 14 from dust or the like.

Protrusion 21 has a cylindrical shape and is formed of an insulating resin such as a polyimide resin. Protrusion 21 is fixed to the upper surface of sheet 15 corresponding to the center of movable contact 14 with a thermosetting adhesive (not shown).

Figure 3:
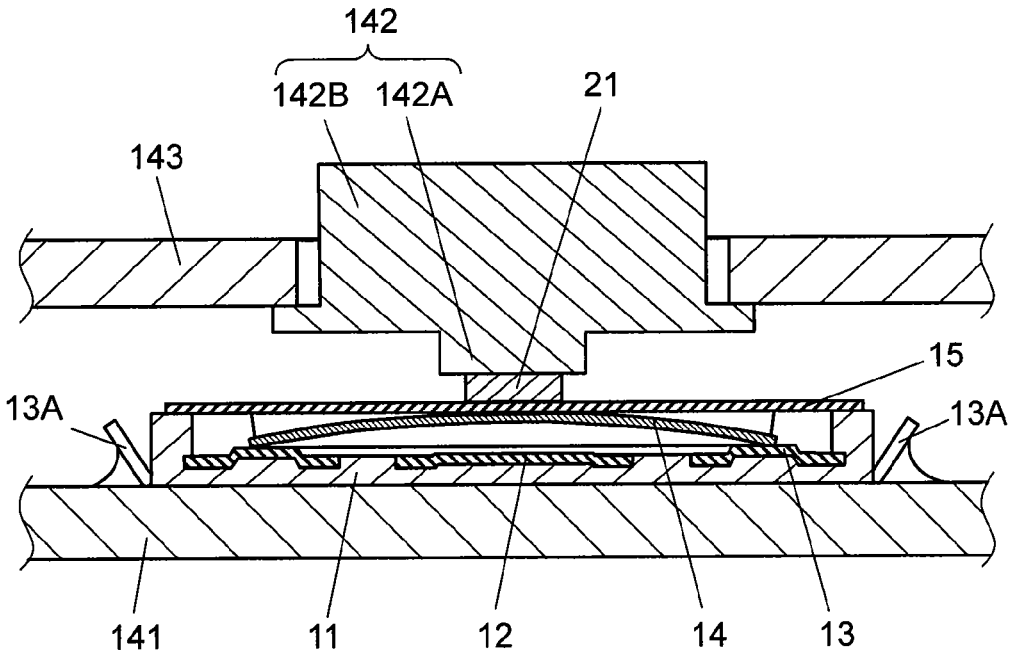
FIG. 3 is a sectional view of the push switch mounted on an electronic apparatus in accordance with the embodiment of the present invention.

Next, an operation of the push switch in accordance with this embodiment is described. FIG. 3 is a sectional view of the push switch mounted on an electronic apparatus in accordance with the embodiment of the present invention. Terminals 12A and 13A of the push switch are packaged on the upper surface of wiring board 141 by soldering.

Operation button 142 includes pressing part 142A protruding downward and having a circular bottom surface, and operation part 142B protruding upward. Operation button 142 is formed of insulating resin. Pressing part 142A is brought into contact with an upper surface of sheet 15 via protrusion 21. Operation part 142B protrudes upward from a hole provided at operation panel 143 of an electronic apparatus.

Figure 4:
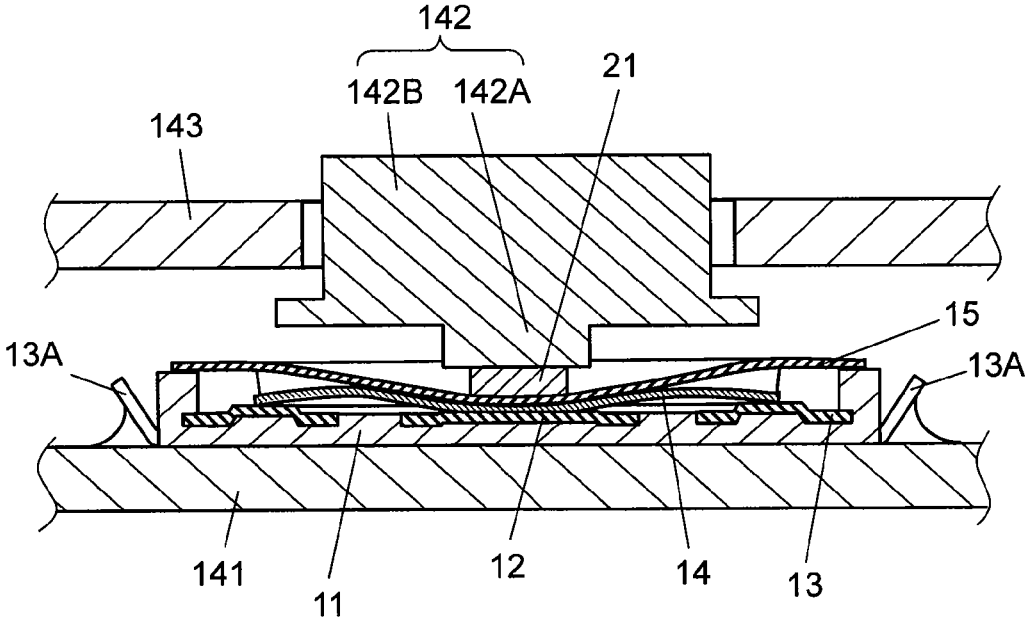
FIG. 4 is a sectional view showing a state in which a movable contact and a center contact come into contact with each other in the push switch in accordance with the embodiment of the present invention.

FIG. 4 is a sectional view showing a state in which movable contact 14 and center contact 12 come into contact with each other in the push switch in accordance with the embodiment of the present invention. When a pressing force is applied to operation part 142B, the pressing force is applied from pressing part 142A to protrusion 21, and the pressing force is applied to movable contact 14 via sheet 15. When the pressing force is beyond a predetermined force, as shown in FIG. 4, the center of the dome shape of movable contact 14 is elastically reversed in a downward-convex form with a click feeling and comes into contact with center contact 12. As a result, outer contacts 13 and center contact 12 become electrically conductive with each other via movable contact 14, and the switch is turned on.

Next, when the pressing force applied to operation button 142 is released, the center of the dome shape of movable contact 14 elastically returns to its original upward-convex shape with a click feeling by elasticity of movable contact 14 itself. Accordingly, the center of movable contact 14 is apart from center contact 12, outer contacts 13 and center contact 12 are insulated from each other, and the switch is turned off. A returning force of movable contact 14 allows operation button 142 to move upward via protrusion 21 of sheet 15, so that the push switch returns to its original shape shown in FIG. 3.

Figure 5:
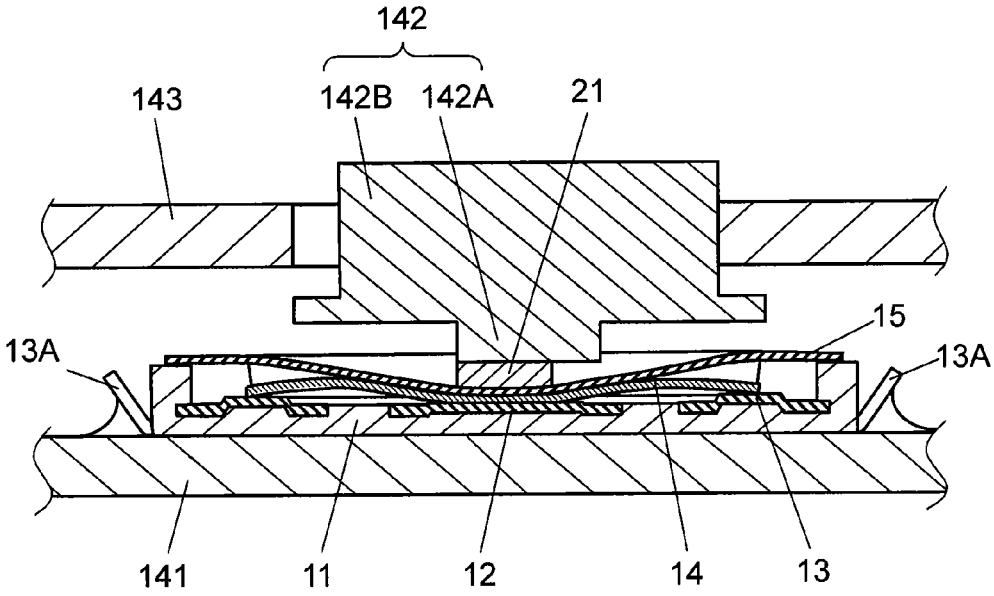
FIG. 5 is a sectional view showing a state in which a center of a pressing part and a center of the movable contact are displaced from each other in the push switch in accordance with the embodiment of the present invention.

FIG. 5 is a sectional view showing a state in which the center of pressing part 142A and the center of movable contact 14 are displaced from each other in the push switch in accordance with the embodiment of the present invention. Even if a position of the center of pressing part 142A is displaced from a position of the center of movable contact 14, the lower surface of pressing part 142A presses protrusion 21. Accordingly, movable contact 14 is pressed in the same position as in the case in which pressing part 142A and movable contact 14 are not displaced from each other. As a result, the elastically reversing operation and elastically returning operation of movable contact 14 are stable, and thus a light and stable click feeling can be obtained.

Figure 6:
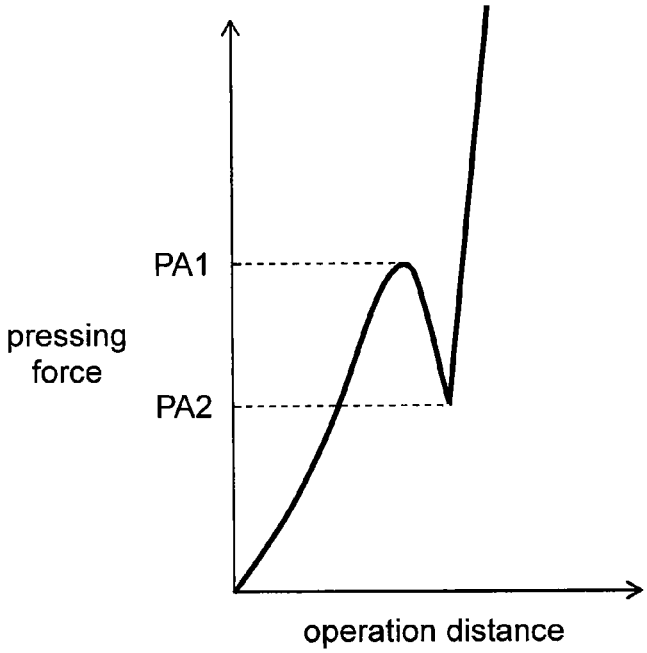
FIG. 6 is a graph showing a relation between an operation distance and a pressing force in the push switch in accordance with the embodiment of the present invention.

FIG. 6 is a graph showing a relation between an operation distance and a pressing force of the push switch in accordance with the embodiment of the present invention. The axis of abscissas shows the operation distance, and the axis of ordinates shows the pressing force. In the push switch of this embodiment, a peak pressing force immediately before movable contact 14 receives a pressing force and is elastically reversed is denoted by PA1, and a bottom pressing force immediately after movable contact 14 is elastically reversed is denoted by PA2. Peak pressing force PA1 and bottom pressing force PA2 are substantially the same as those of a conventional push switch when the diameter of protrusion 21 is the same as that of pressing part 42A of operation button 42. Furthermore, as shown in FIG. 5, even in a state in which the center of pressing part 142A and the center of movable contact 14 are displaced from each other, peak pressing force PA1 and bottom pressing force PA2 are substantially the same as those shown in FIG. 6, and substantially the same as those of a conventional push switch.

Therefore, the click rate: (PA1−PA2)×100/PA1 is substantially the same value as that of the conventional push switch.

Furthermore, even in a state in which the center of pressing part 142A and the center of movable contact 14 are displaced from each other, a stable click feeling can be obtained.

In the push switch of this embodiment, when a polyimide resin is used for protrusion 21, the operation distance and the pressing force have a relation shown in FIG. 6. Peak pressing force PA1 is 3.6 N and bottom pressing force PA2 is 2.2 N, and thus, the click rate is 38.9%.

Figure 7:
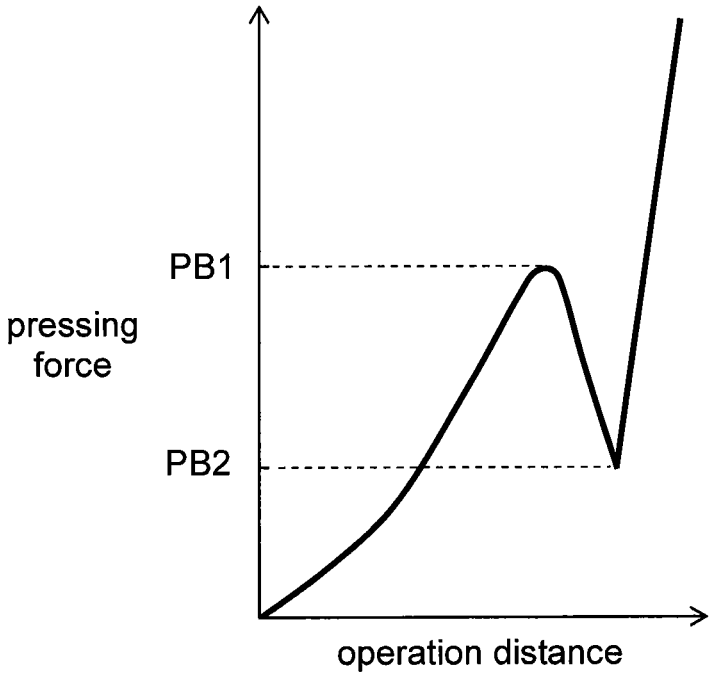
FIG. 7 is a graph showing an operation distance and a pressing force in the push switch provided with a protrusion having elasticity in accordance with the embodiment of the present invention.
Figure 8:
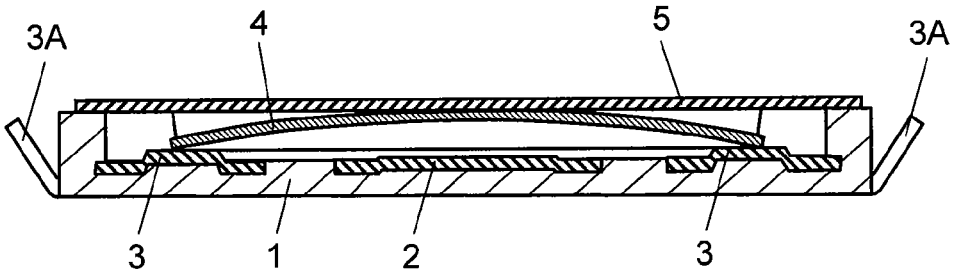
FIG. 8 PRIOR ART
FIG. 8 is a sectional view of a conventional push switch.
Figure 9:
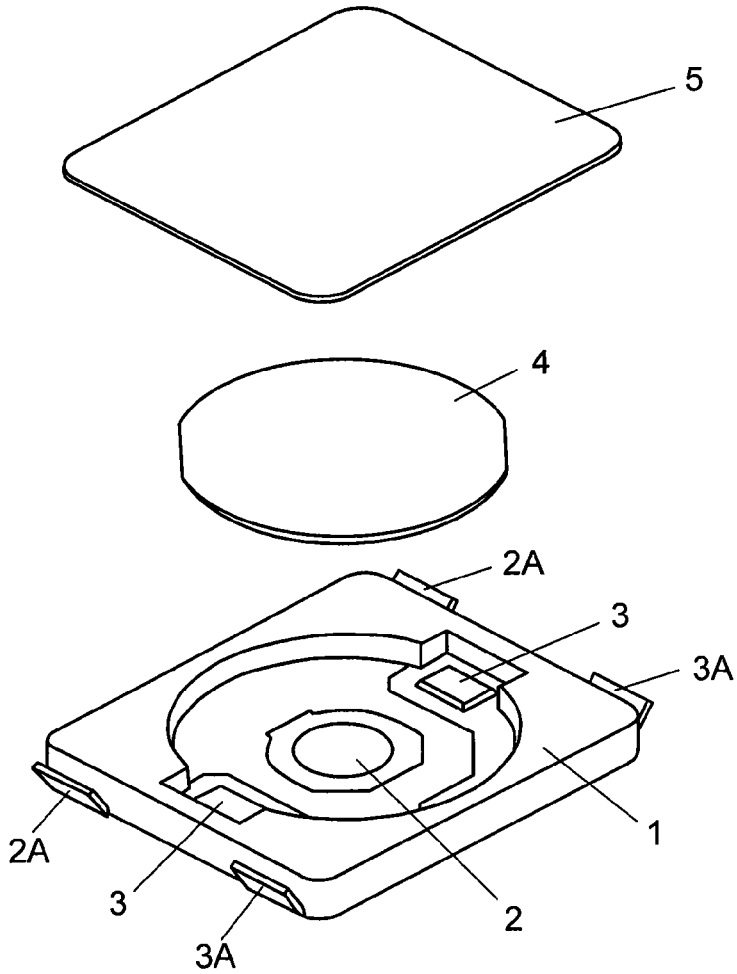
FIG. 9 PRIOR ART
FIG. 9 is an exploded perspective view of the conventional push switch.
Figure 10:
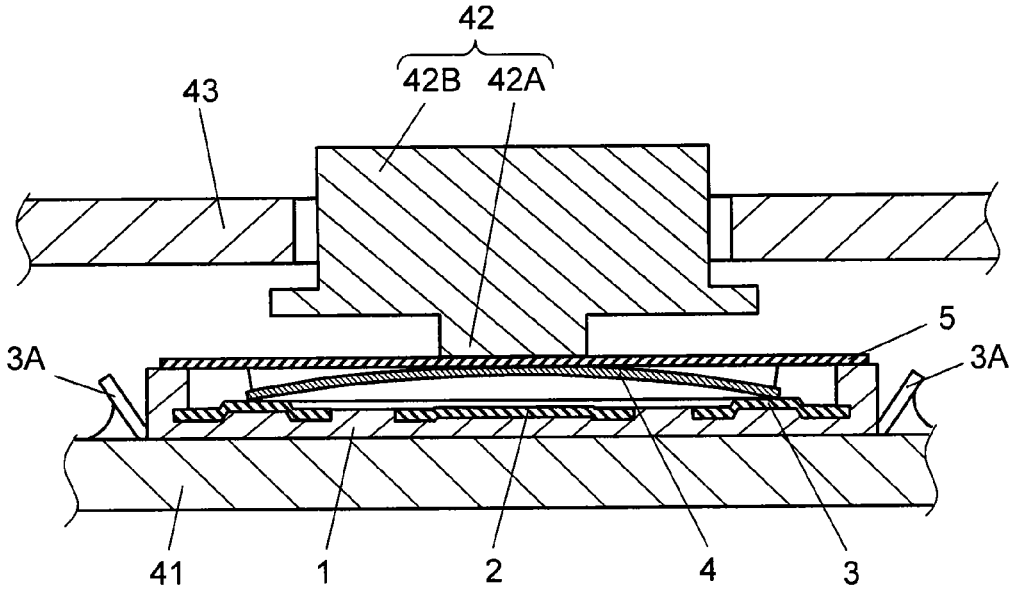
FIG. 10 PRIOR ART
FIG. 10 is a sectional view of the conventional push switch mounted on an electronic apparatus.
Figure 11:
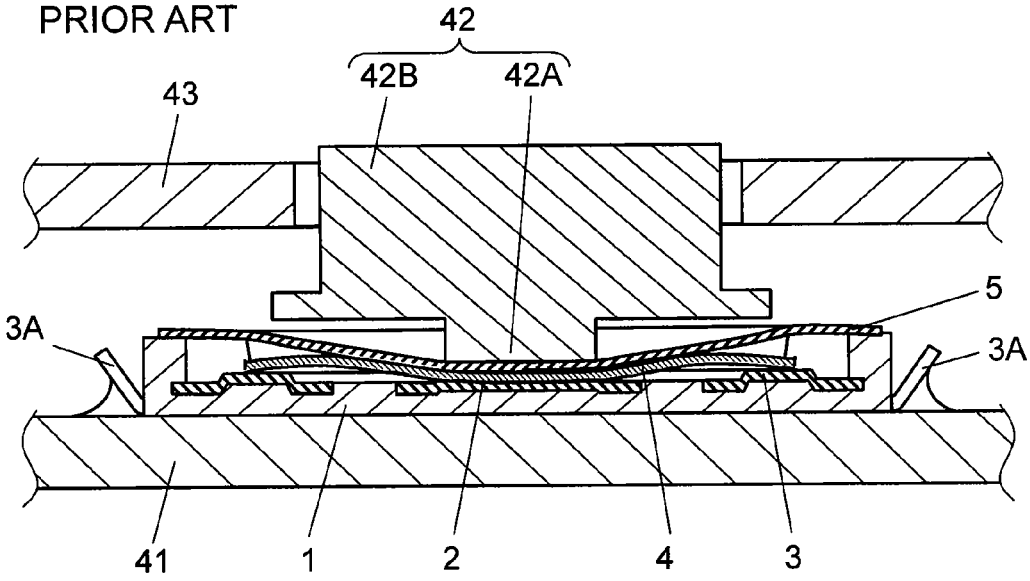
FIG. 11 PRIOR ART
FIG. 11 is a sectional view showing a state in which a movable contact and a center contact come into contact with each other in the conventional push switch.
Figure 12:
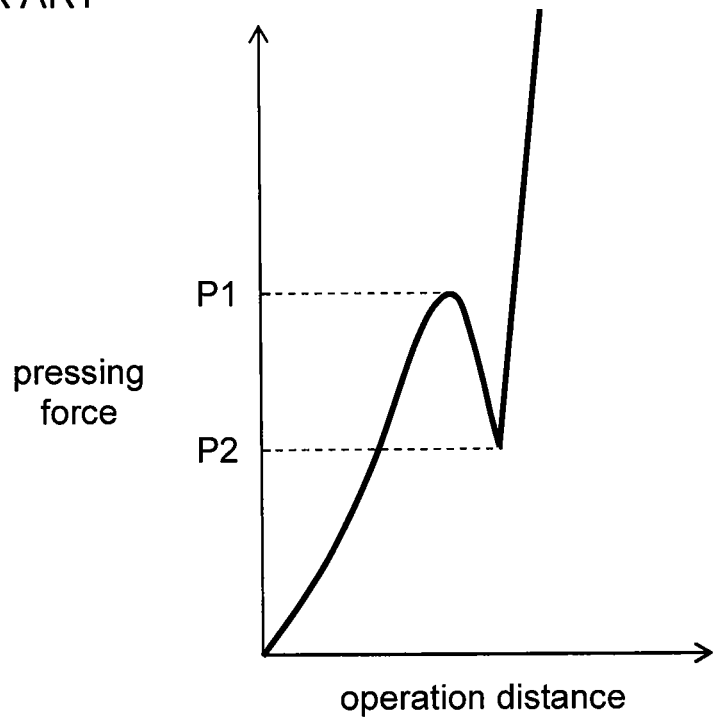
FIG. 12 PRIOR ART
FIG. 12 is a graph showing a relation between an operation distance and a pressing force in the conventional push switch.

Furthermore, FIG. 7 is a graph showing a relation between an operation distance and an pressing force in the push switch provided with a protrusion having elasticity in accordance with the embodiment of the present invention. The axis of abscissas shows the operation distance and the axis of ordinates shows the pressing force. When ethylene propylene diene rubber is used for protrusion 21, the operation distance and the pressing force have a relation shown in FIG. 7. Peak pressing force PB1 is 3.3 N and bottom pressing force PB2 is 1.5 N, and thus, the click rate is 54.5%. When protrusion 21 is formed of elastomer having elasticity, for example, ethylene propylene diene rubber, the click feeling can be further improved and the operation distance can be increased.

When protrusion 21 has elasticity like ethylene propylene diene rubber, as compared with the case where polyimide resin is used, in a state in which movable contact 14 is elastically reversed, pressing of sheet 15 is loosened in the vicinity of the outer periphery of protrusion 21. Accordingly, a returning force by the bending of sheet 15 itself is weakened, so that bottom pressing force PB2 is thought to be smaller than PA2.

Furthermore, in this embodiment, protrusion 21 receives a pressing force and is compressed, so that an operation distance until peak pressing force PB1 and bottom pressing force PB2 occur is increased. Since the operation distance until the peak pressing force PB1 occurs is increased, the pressing amount until the click feeling occurs is perceived. As a result, a push switch having a moderate stroke feeling can be obtained. It is preferable that an operation distance until peak pressing force PB1 occurs in this embodiment is longer by about 5% to 25% as compared with the conventional operation distance until peak pressing force P1 occurs.

When protrusion 21 is too soft and too hard, a moderate stroke feeling cannot be obtained. Therefore, it is preferable that protrusion 21 has hardness according to JIS K 6253 durometer type A of 55 or more and 70 or less. Herein, the JIS K 6253 is a standard of a hardness test of rubber, and the durometer is a hardness tester.

In this embodiment, a cylindrical insulating resin is fastened to the upper surface of sheet 15 with an adhesive so as to form protrusion 21. However, protrusion 21 may be formed by applying a predetermined amount of adhesives to the upper surface of sheet 15 and hardening thereof. Furthermore, protrusion 21 may be formed directly on movable contact 14 without installing sheet 15. Furthermore, the shape of protrusion 21 may have a shape other than a cylindrical shape, for example, substantially a dome shape.

Furthermore, outer contacts 13 are installed in two places with a predetermined distant from center contact 12. However, outer contact 13 is not necessarily installed in two places, and may be in one place or in three places or more. Furthermore, instead of outer contact 13, a second fixed contact that is not in contact with movable contact 14 before pressing may be provided in the vicinity of center contact 12. The second fixed contact may be electrically conductive with center contact 12 as a first fixed contact via movable contact 14 when movable contact 14 is reversed.

As mentioned above, even if displacement occurs when the push switch is mounted on an electronic apparatus, the center of movable contact 14 is pressed. Furthermore, it is possible to suppress variation of switch feeling for each electronic apparatus due to variation of the position displacement when the switch is mounted on the electronic apparatus. Therefore, a small and thin push switch capable of giving a light and stable click feeling can be achieved. Furthermore, protrusion 21 has elasticity, and protrusion 21 is compressed until movable contact 14 is elastically reversed at the time of pressing operation. Since the protrusion bends earlier than movable contact 14 at the time of pressing, an operation distance until movable contact 14 is elastically reversed is increased. As a result, it is possible to achieve a push switch in which a stroke feeling is perceived to be long. Therefore, the push switch of the present invention is useful in input operations in various electronic apparatuses.

What is claimed is:

1. A push switch comprising:

a first fixed contact;

a second fixed contact disposed apart from the first fixed contact;

a movable contact facing the first fixed contact with a space therebetween, the movable contact being metallic and dome-shaped; and a protrusion disposed above a center of the movable contact, wherein when the protrusion is pressed, the movable contact elastically deforms, and while remaining deformed, the first fixed contact and the second fixed contact are electrically conductive with each other via the movable contact, wherein the protrusion is elastic, wherein a first force deforms the movable contact and a second force less than the first force maintains the movable contact deformed while the first contact and the second contact are electrically conductive with each other.

2. The push switch of claim 1, further comprising:

a sheet covering the movable contact, wherein the protrusion is formed on the sheet.

3. The push switch of claim 1, wherein the protrusion is formed of elastomer.

4. The push switch of claim 1, wherein a following formula is established, $$40 \leq (P1-P2) \times 100/P1 \leq 60$$

where P1 represents a pressure before the elastic deformation of the movable contact, and P2 represents a pressure after the elastic deformation of the movable contact.

5. The push switch of claim 1, further comprising:

an operation button including an operation part and a pressing part, the operation button being disposed above the protrusion, wherein when the operation part is pressed, the pressing part presses the protrusion.

6. The push switch of claim 1, wherein the protrusion has hardness according to JIS K durometer type A of 55 or more.

* * * * *